US009193486B2

(12) United States Patent
Neeser et al.

(10) Patent No.: US 9,193,486 B2
(45) Date of Patent: Nov. 24, 2015

(54) STRAPPING DEVICE WITH A TENSIONER

(75) Inventors: Mirco Neeser, Ennetbaden (CH); Roland Widmer, Bremgarten (CH); Flavio Finzo, Wuerenlos (CH)

(73) Assignee: Signode Industrial Group LLC, Glenview, IL (US)

( * ) Notice: Subject to any disclaimer, the term of this patent is extended or adjusted under 35 U.S.C. 154(b) by 692 days.

(21) Appl. No.: 12/989,281

(22) PCT Filed: Jan. 6, 2009

(86) PCT No.: PCT/CH2009/000004

§ 371 (c)(1), (2), (4) Date: Nov. 23, 2010

(87) PCT Pub. No.: WO2009/129636

PCT Pub. Date: Oct. 29, 2009

(65) Prior Publication Data

US 2011/0056392 A1 Mar. 10, 2011

(30) Foreign Application Priority Data

Apr. 23, 2008 (CH) ..... 648/08

(51) Int. Cl.
*B65B 13/24* (2006.01)
*B65B 13/22* (2006.01)
(Continued)

(52) U.S. Cl.
CPC ..... *B65B 13/322* (2013.01); *B65B 13/025* (2013.01); *B65B 13/187* (2013.01)

(58) Field of Classification Search
CPC .. B65B 13/322; B65B 13/025; B65B 13/187; B65B 13/185; B65B 13/22; B65B 13/32; B65B 13/327
USPC ..... 100/29, 32, 33 PB
See application file for complete search history.

(56) References Cited

U.S. PATENT DOCUMENTS 3,367,374 A 2/1968 Meier et al.
3,654,033 A * 4/1972 Angarola et al. ..... 156/494
(Continued)

FOREIGN PATENT DOCUMENTS

CN 1253099 A 5/2000
CN 1558842 12/2004
(Continued)

OTHER PUBLICATIONS

ISR for PCT/CH2009/000004 mailed Apr. 6, 2009.
(Continued)

*Primary Examiner* — Shelley Self
*Assistant Examiner* — Chwen-Wei Su
(74) *Attorney, Agent, or Firm* — Neal, Gerber & Eisenberg LLP

(57) ABSTRACT

A strapping device, in particular a mobile strapping device, for strapping packaged goods with a wrap-around strap, including a tensioner for applying a strap tension to a loop of a wrapping strap. The tensioner includes a rotationally drivable tensioning wheel and a tensioning rocker that pivots relative to the tensioning wheel and cooperates with the tensioning wheel, wherein a tensioning plate is disposed at the tensioning rocker for applying a wrapping strap, and a wherein a distance between the tensioning plate and the tensioning wheel can be varied for applying a tension on the strap, said tensioner also comprising a connector, in particular a welding connector such as a friction welder, for producing a connection in two areas of the loop of the wrapping strap located one on top of the other, is intended to exhibit largely consistent tensioning characteristics even with different strap thicknesses.

28 Claims, 9 Drawing Sheets

(51) Int. Cl.

| | |
|---|---|
| ***B65B 13/32*** | (2006.01) |
| ***B65B 13/02*** | (2006.01) |
| ***B65B 13/18*** | (2006.01) |

(56) References Cited

U.S. PATENT DOCUMENTS

| | | | | |
|---|---|---|---|---|
| 4,011,807 | A | 3/1977 | Kobiella | |
| 4,015,643 | A | 4/1977 | Cheung | |
| 4,313,779 | A * | 2/1982 | Nix | 156/361 |
| 4,450,032 | A | 5/1984 | Wehr | |
| 4,572,064 | A | 2/1986 | Burton et al. | |
| 4,707,390 | A | 11/1987 | Cheung | |
| 4,776,905 | A | 10/1988 | Cheung et al. | |
| 5,133,532 | A | 7/1992 | Figiel et al. | |
| 5,146,847 | A | 9/1992 | Lyon et al. | |
| 5,155,982 | A | 10/1992 | Boek et al. | |
| 5,159,218 | A | 10/1992 | Murry et al. | |
| 5,516,022 | A | 5/1996 | Annis, Jr. | |
| 5,689,943 | A | 11/1997 | Wehr | |
| 5,690,023 | A | 11/1997 | Stamm et al. | |
| 5,798,596 | A | 8/1998 | Lordo | |
| 5,809,873 | A | 9/1998 | Chak et al. | |
| 6,003,578 | A | 12/1999 | Chang | |
| 6,109,325 | A | 8/2000 | Chang | |
| 6,308,760 | B1 | 10/2001 | Finzo et al. | |
| 6,332,306 | B1 | 12/2001 | Finzo et al. | |
| 6,405,766 | B1 * | 6/2002 | Benjey | 141/198 |
| 6,516,715 | B1 * | 2/2003 | Reiche | 100/29 |
| 6,578,337 | B2 | 6/2003 | Scholl et al. | |
| 6,606,766 | B2 | 8/2003 | Ko | |
| 6,644,713 | B2 | 11/2003 | Del Pozo Abejon et al. | |
| 6,715,375 | B2 | 4/2004 | Nestler | |
| 6,732,638 | B1 | 5/2004 | Rometty et al. | |
| 6,817,159 | B2 | 11/2004 | Sakaki et al. | |
| 6,918,235 | B2 * | 7/2005 | Nix | 53/582 |
| 7,011,000 | B2 | 3/2006 | Kushida et al. | |
| 7,249,862 | B2 | 7/2007 | Shirane | |
| 7,312,609 | B2 | 12/2007 | Schmollngruber et al. | |
| 7,456,608 | B2 | 11/2008 | Kageler et al. | |
| 8,198,839 | B2 | 6/2012 | Katou et al. | |
| 8,378,600 | B2 | 2/2013 | Katou et al. | |
| 2002/0100146 | A1 | 8/2002 | Ko | |
| 2002/0129717 | A1 | 9/2002 | Helland et al. | |
| 2003/0145900 | A1 | 8/2003 | Jensen et al. | |
| 2005/0279198 | A1 | 12/2005 | Kushida et al. | |
| 2006/0108180 | A1 | 5/2006 | Grach et al. | |
| 2006/0192527 | A1 | 8/2006 | Kageler et al. | |
| 2009/0013656 | A1 * | 1/2009 | Nasiatka et al. | 53/582 |

FOREIGN PATENT DOCUMENTS

| | | | |
|---|---|---|---|
| CN | 1859999 | | 11/2006 |
| CN | 201411061 | | 2/2010 |
| DE | 19751861 | | 1/1999 |
| DE | 10026200 | | 11/2001 |
| DE | 20321137 | U1 | 1/2006 |
| EP | 0480627 | A1 | 4/1992 |
| EP | 0744343 | | 11/1996 |
| EP | 0949146 | | 10/1999 |
| EP | 0997377 | A1 | 5/2000 |
| EP | 0999133 | | 5/2000 |
| EP | 1316506 | | 6/2003 |
| EP | 1413519 | A1 | 4/2004 |
| JP | 52-90398 | | 7/1977 |
| JP | S5290398 | | 7/1977 |
| JP | 541238 | | 1/1979 |
| JP | S5638220 | A | 4/1981 |
| JP | S6322320 | A | 1/1988 |
| JP | 05198241 | | 8/1993 |
| JP | 07300108 | | 11/1995 |
| JP | 08258808 | | 10/1996 |
| JP | 08-324506 | | 12/1996 |
| JP | H09283103 | A | 10/1997 |
| JP | 2000-128113 | | 5/2000 |
| JP | 3044132 | | 5/2000 |
| JP | 2000128115 | A | 5/2000 |
| JP | 3227693 | | 11/2001 |
| JP | 3242081 | | 12/2001 |
| JP | 2002235830 | A | 8/2002 |
| JP | 2003170906 | | 6/2003 |
| JP | 2003231291 | A | 8/2003 |
| JP | 2003348899 | A | 12/2003 |
| JP | 2004108593 | | 4/2004 |
| JP | 3548622 | | 7/2004 |
| JP | 2004241150 | | 8/2004 |
| JP | 2004323111 | | 11/2004 |
| JP | 2007276042 | A | 10/2007 |
| JP | 4406016 | | 1/2010 |
| KR | 840002211 | | 12/1984 |
| KR | 20000029337 | | 5/2000 |
| RU | 1772784 | C | 10/1992 |
| RU | 2118277 | C1 | 8/1998 |
| RU | 2161773 | | 1/2001 |
| RU | 2004115639 | A | 1/2006 |
| RU | 2355281 | | 5/2009 |
| SU | 1134117 | | 1/1985 |
| WO | 2006/048738 | | 5/2006 |
| WO | WO 2007/116914 | | 10/2007 |
| WO | WO 2009/129633 | | 10/2009 |
| WO | WO 2009/129636 | | 10/2009 |

OTHER PUBLICATIONS

An RU Decision to Grant, dated Sep. 6, 2012, issued in RU Application No. 2010147640.

Brushless DC Motor Drives, By Ali Emandi, in Energy-Efficient Electrical Motors, 3rd ed., Aug. 2004, ¶. 270-272, CRC Press & Marcel Dekker.

Lithium ion technology: shaping power tool. By Bender, in Air conditioning, heating, and refrigeration news. vol. 228, Issue 14, p. 18 Jul. 31, 2006.

Korean Office Action dated Apr. 6, 2015 for Korean Application No. 10-2010-7023734 (6 pages).

* cited by examiner

STRAPPING DEVICE WITH A TENSIONER

RELATED APPLICATIONS

The present application is national phase of International Application Number PCT/CH2009/000004 filed Jan. 6, 2009, and claims priority from, Swiss Application Number 648/08 filed Apr. 23, 2008.

The invention relates to a strapping device, more particularly a mobile strapping device, for strapping packaged goods with a wrapping strap, comprising a tensioner for applying a strap tension to a loop of a wrapping strap, a rotationally drivable tensioning wheel as well as tensioning rocker that can be pivoted relative to the tensioning wheel and acts together with the tensioning wheel, whereby a tensioning plate is arranged on the tensioning rocker for applying a wrapping strap and a distance between the tensioning plate and the tensioning wheel can be changed in order to apply a tension force to the strap, and a connector, more particularly a welding device, such as a friction welder, for producing a connection at two areas of the loop of wrapping strap disposed one on top of the other.

In strapping devices of this type a rotationally drivable tensioning wheel works in conjunction with a toothed and generally concavely curved tensioning plate which is arranged on a pivotable rocker. In order to apply a tension force to a strap loop the rocker can be pivoted in the direction of the tensioning wheel and pressed against the tensioning wheel. As a rule a pivoting axis of the rocker does not correspond with the rotational axis of the tensioning wheel. This allows the rocker to be "opened" and "closed" with regard to the tensioning wheel, whereby the strap to be tensioned can be placed in the strapping device, held and tensioned by the tensioner and then removed again. In the area between the tensioning wheel and the tensioning plate the strap loop is in two layers. The lower layer is grasped by the tensioning plate of the rocked pivoted towards the tensioning wheel, and through its surface structure or other suitable means for producing friction, held on the tensioning plate by the pressure exerted by the tensioning plate on the lower strap layer. In this way it is possible to grasp and retract the upper layer with the rotationally driven tensioning wheel. In the strap loop this brings about or increases the strap tension and straps the loop tightly around the packaged goods.

Such strapping devices are mainly used in conjunction with plastic straps, loops of which are connected by means of a friction weld. The strapping device therefore has a friction welder with which the strap loops in the area of the two layers of strap one on top of the other can be heated in the strapping device by means of an oscillating friction welding element until the plastic strap melts locally, the materials of the two strap layers flow into each other and are firmly connected on cooling.

It has been shown that in such strapping devices the applied strap tension can vary considerably, particularly in the case of various strap thicknesses. The aim of the invention is therefore to create a strapping device of the type set out in the introductory section, with which even with different strap thicknesses, as equally good tension properties as possible can be achieved.

This is achieved in the strapping device of the type set out in the introductory section in that the tensioning plate is movably arranged on the tensioning rocker.

Within the framework of the invention it was seen that the fluctuating strap tension in the case of different strap widths is due to the fact that the position of the tensioning plate changes in relation to the tensioning wheel. In this way, depending on the strap thicknesses involved, different engaging and pressing conditions occur between the two strap layers on the one hand, and the tensioning plate and tensioning wheel on the other hand. The invention therefore envisages means of compensating for the displacement of the engaging points. This at least one means can involve a relative mobility of the tensioning plate with regard to the tensioning rocker, more particularly floating bearing of the tensioning plate on the tensioning rocker. Alternatively, or in addition thereto, a change in the position of the tensioning wheel in relation to the pivoting axis of the rocker can be envisaged.

The preferably envisaged relative mobility of the tensioning plate with regard to the tensioning rocker should, in particular, be present in a direction in which a position of the tensioning plate can be changed with regard to the circumference of the tensioning wheel. This direction corresponds at least approximately to the longitudinal direction along which a wrapping strap placed in the strapping device extends within the strapping device, or the direction along which the tensioning plate moved as a result of the rocker movement. Such an embodiment has the advantage that the pressing pressure, more particularly an essentially evenly distributed pressing pressure is made possible by the tensioning plate on the strap and/or the strap on the tensioning wheel, irrespective of the strap thickness, essentially over the entire length of the tensioning plate.

Alternatively, or in addition to the mobility of the tensioning plate, the engaging conditions can be further improved, even for different strap thicknesses, in that the tensioning plate is concavely curved in one radius, which advantageously approximately corresponds with or can be slightly larger than the outer radius of the tensioning wheel. During the tensioning procedure such a concave design of the tensioning surface contributes to providing a gap with an approximately constant gap height between the tensioning surface of the tensioning plate and the external surface of the tensioning wheel over preferably the entire length of the tensioning surface—in relation to the tensioning direction.

In contrast to the solution in accordance with the invention, in the previous solution a distribution of the pressing pressure on a surface section of the wrapping strap was essentially only possible at a certain strap thickness, through which the rocker took up a position at which the curvature of the tensioning plate runs parallel to the circumference of the tensioning radius. The gap between the tensioning wheel and the tensioning plate therefore only had a constant gap height over the entire length of the tensioning plate at a certain strap thickness. The more the strap thickness differed from a strap thickness fitting this gap, the smaller surface of the upper and lower strap layer, on which the tensioning plate/tensioning wheel could act. With the embodiment in accordance with the invention it is now possible to compensate for the different pivoting positions of the rocker in relation to the tensioning wheel due to the different strap thicknesses in such a way that despite the different positions of the tensioning rocker, the tensioning plate can always be essentially arranged so that over the entire length of the tensioning plate there is a gap with an essentially constant gap height over the entire, or at least with less gap height variation than in previous solution. Over the entire length of the tensioning plate this allows more even pressure application on the wrapping strap than hitherto.

The solution according to the invention exhibits advantages to a particular extent in the case of small packaged goods (edge length approx. 750 mm and less) as well as round packaged goods (diameter approx. 500-1000 mm) in connection with high tensile forces. In these conditions the then comparatively small strap loop had resulted in shock-like stressing of the lower strap layer, i.e. the strap end, through which the lower strap layer is pulled against the tensioning plate. Due to very different pressing conditions over the entire length of the tensioning plate, securing holding of the strap end in the strapping device could not guaranteed in previous solutions. The movable tensioning plate exhibits decisive advantages here, which are essentially seen in the fact that even at shock-like tensile stresses in connection with high tensile forces, the straps can be held by the toothed plate, which is optimally arranged because of its mobility.

In a preferred form of embodiment of the invention, the relative mobility of the tensioning plate can be realised by arranging the tensioning plate on the rocker using bearing surfaces of the tensioning plate that are not parallel to each other. On the basis of this principle the tensioning plate can be provided with a convex contact surface which rests on an essentially level contact surface of the rocker. This allows pivoting of the tensioning plate, whereby self-alignment and clinging of the tensioning plate to the circumference of the tensioning wheel can take place. In a preferred form of embodiment measures can be envisaged through which self-alignment of the tensioning plate in a direction perpendicular to the direction of the strap can be achieved. Such a measure can for example be a convex shaping of the bearing surface of the tensioning plate perpendicularly to the direction of the strap.

A further advantageous embodiment of the invention can also envisage the tensioning plate being provided with a guide, through which a movement in one or several predetermined directions takes place. The guide direction can in particular be a direction which is essentially parallel to the direction of the strap within the strapping device. In an expedient embodiment, the guide for the tensioning plate can also be produced by an elongated hold and a guide means, such as a screw, arranged therein.

Further preferred embodiments of the invention are set out in the claims, the description and the drawing.

The invention will be described in more detail by way of the examples of embodiment which are shown purely schematically.

Figure 1:
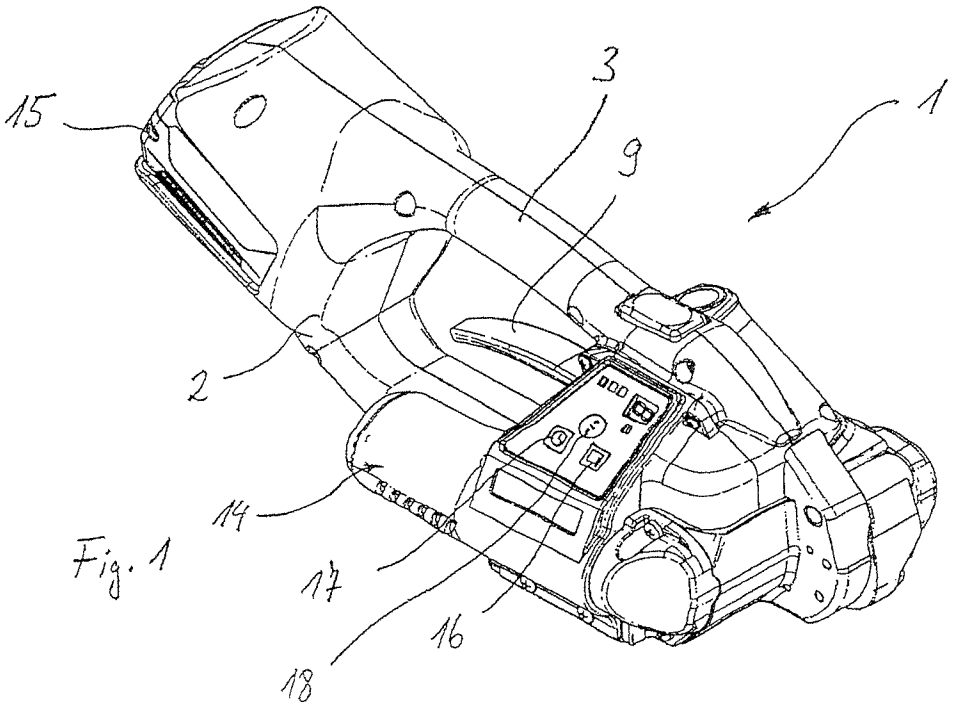
FIG. 1 is a perspective view of a strapping device in accordance with the invention.
Figure 2:
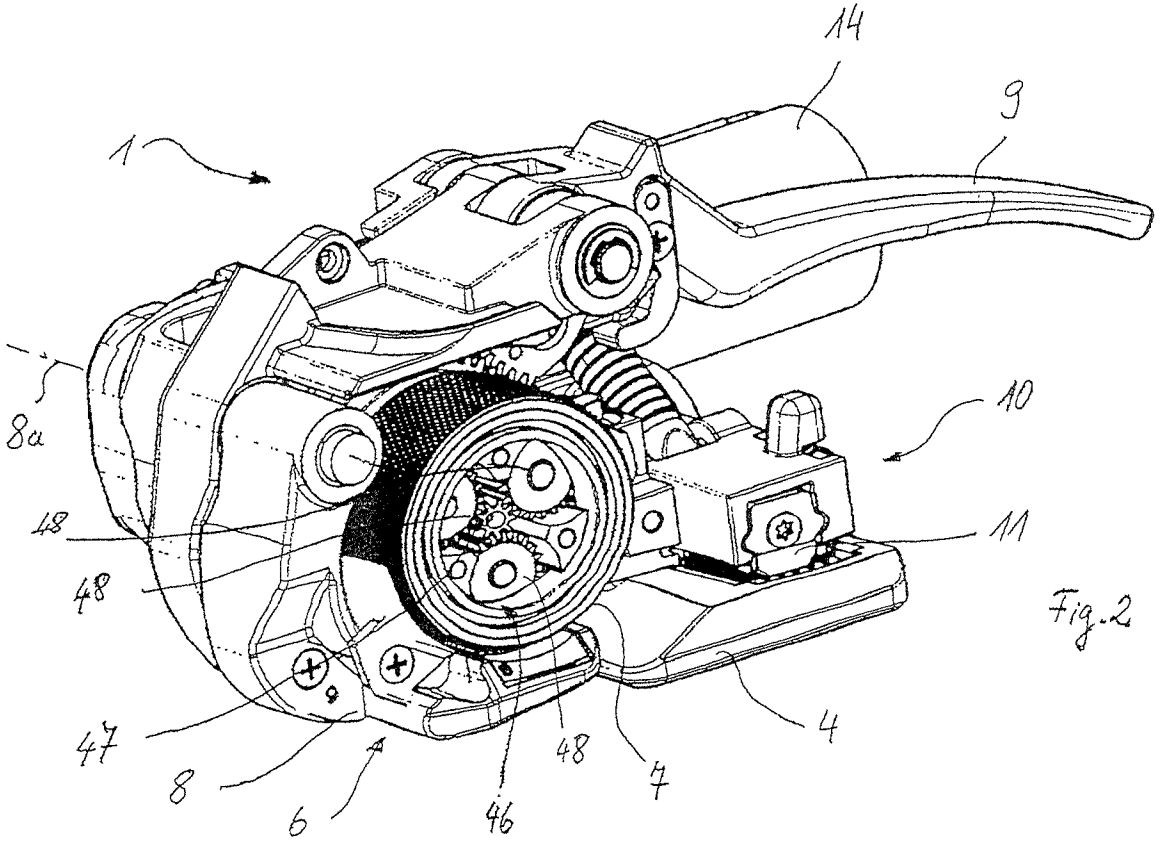
FIG. 2 shows the strapping device in FIG. 1 with the casing.
Figure 10:
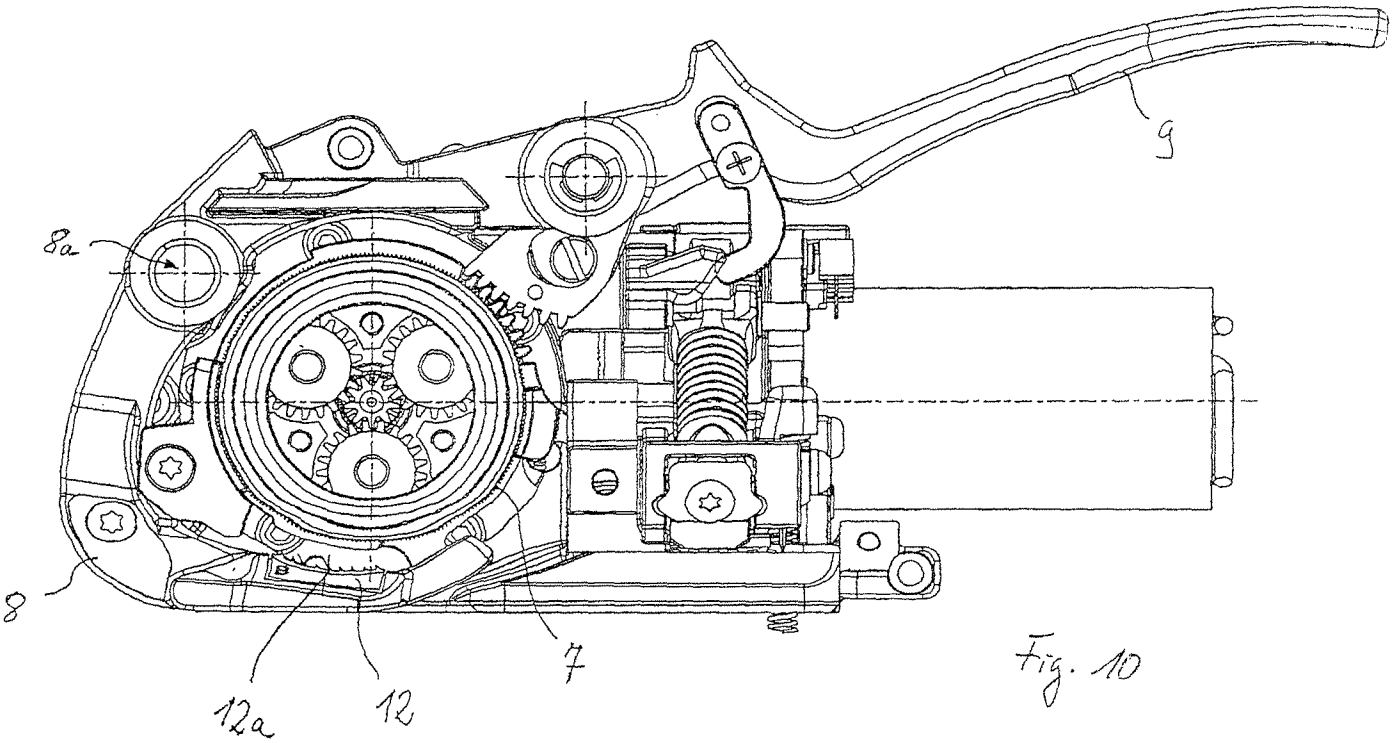
FIG. 10 shows a side view of the tensioner of the strapping device without the casing, in which a tensioning rocker is in a rest position.
Figure 13:
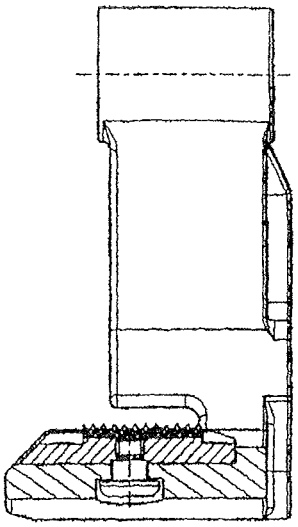
Figure 12:
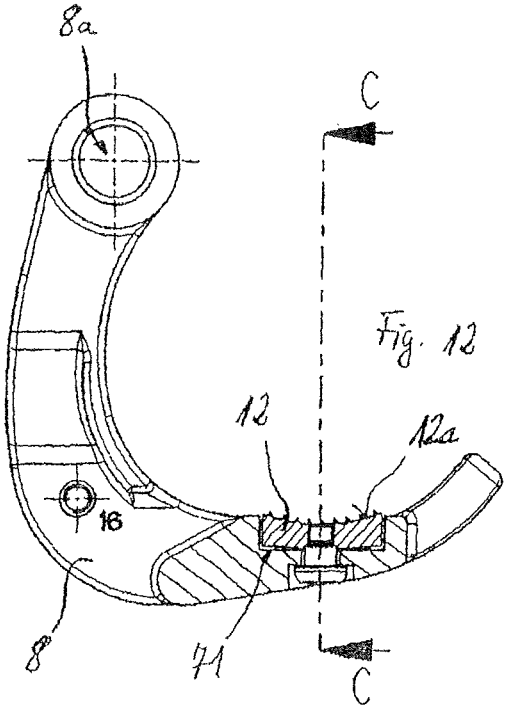
Figure 14:
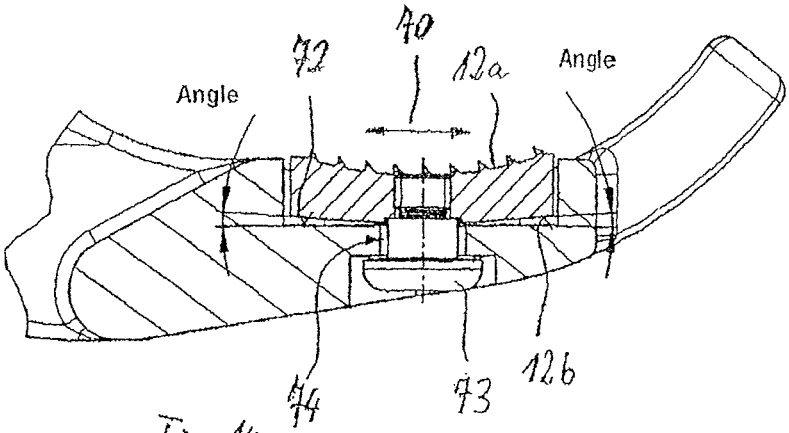

FIG. 12 a side view of the tensioning rocker of the strapping device in FIG. 10 shown in a partial section;

FIG. 13 shows a front view of the tensioning rocker in FIG. 12;

FIG. 14 shows a detail from FIG. 12 along line C-C;

The exclusively manually operated strapping device 1 in accordance with the invention shown in FIGS. 1 and 2 has a casing 2, surrounding the mechanical system of the strapping device, on which a grip 3 for handling the device is arranged. The strapping device also has a base plate 4, the underside of which is intended for placing on an object to be packed. All the functional units of the strapping device 1 are attached on the base place 4 and on the carrier of the strapping device which is connected to the base plate and is not shown in further detail.

With the strapping device 1 a loop of plastic strap, made for example of polypropylene (PP) or polyester (PET), which is not shown in more detail in FIG. 1 and which has previously been placed around the object to be packed, can be tensioned with a tensioner 6 of the strapping device. For this the tensioner has a tensioning wheel 7 with which the strap can be held for a tensioning procedure. The tensioning wheel 7 operates in conjunction with a rocker 8, which by means of a rocker lever 9 can be pivoted from an end position at a distance from the tensioning wheel into a second end position about a rocker pivoting axis 8*a*, in which the rocker 8 is pressed against the tensioning wheel 7. The strap located between the tensioning wheel 7 and the rocker 8 is also pressed against the tensioning wheel 7. By rotating the tensioning wheel 7 it is then possible to provide the strap loop with a strap tension that is high enough for the purpose of packing. The tensioning procedure, and the rocker 8 advantageously designed for this, is described in more detail below.

Subsequently, at a point on the strap loop on which two layers of the wrapping strap are disposed one on top of the other, welding of the two layers can take place by means of the friction welder 8 of the strapping device. In this way the strap loop can be durably connected. For this the friction welder 10 is provided with a welding shoe 11, which through mechanical pressure on the wrapping strap and simultaneous oscillating movement at a predefined frequencies starts to melt the two layers of the wrapping strap. The plastified or melted areas flow into each other and after cooling of the strap a connection is formed between the two strap layers. If necessary the strap loop can be separated from a strap storage roll by means of a strapping device 1 cutter which is not shown.

Operation of the tensioner 6, assignment of the friction welder 10 by means of a transfer device 19 (FIG. 6) of the friction welder as well as the operation of the friction welder itself and operation of the cutter all take place using only one common electric motor 14, which provides a drive movement for each of these components. For its power supply, an interchangeable storage battery 15, which can be removed for charging, is arranged on the strapping device. The supply of other external auxiliary energies, such as compressed air or additional electricity, is not envisaged in accordance with FIGS. 1 and 2.

The portable mobile strapping device 1 has an operating element 16, in the form of a press switch, which is intended for starting up the motor. Via a switch 17, three operating modes can be set for the operating element 16. In the first mode by operating the operating element 16, without further action being required by the operator, the tensioner 6 and the friction welder 10 are started up consecutively and automatically. To set the second mode the switch 17 is switched over to a second switching mode. In the second possible operating mode, by operating the operating element 15, only the tensioner 6 is started up. To separately start the friction welder 10 a second operating element 18 must be activated by the operator. In alternative forms of embodiment it can also be envisaged that in this mode the first operating element 16 has to be operated twice in order to activate the friction welder. The third mode is a type of semi-automatic operation in which the tensioning button 16 must be pressed until the tension force/tensile force which can preset in stages is achieved in the strap. In this mode it is possible to interrupt the tensioning process by releasing the tensioning button 16, for example in order to position edge protectors on the goods to be strapped under the wrapping strap. By pressing the tensioning button the tensioning procedure can then be continued. This third mode can be combined with a separately operated as well as an automatic subsequent friction welding procedure.

Figure 3:
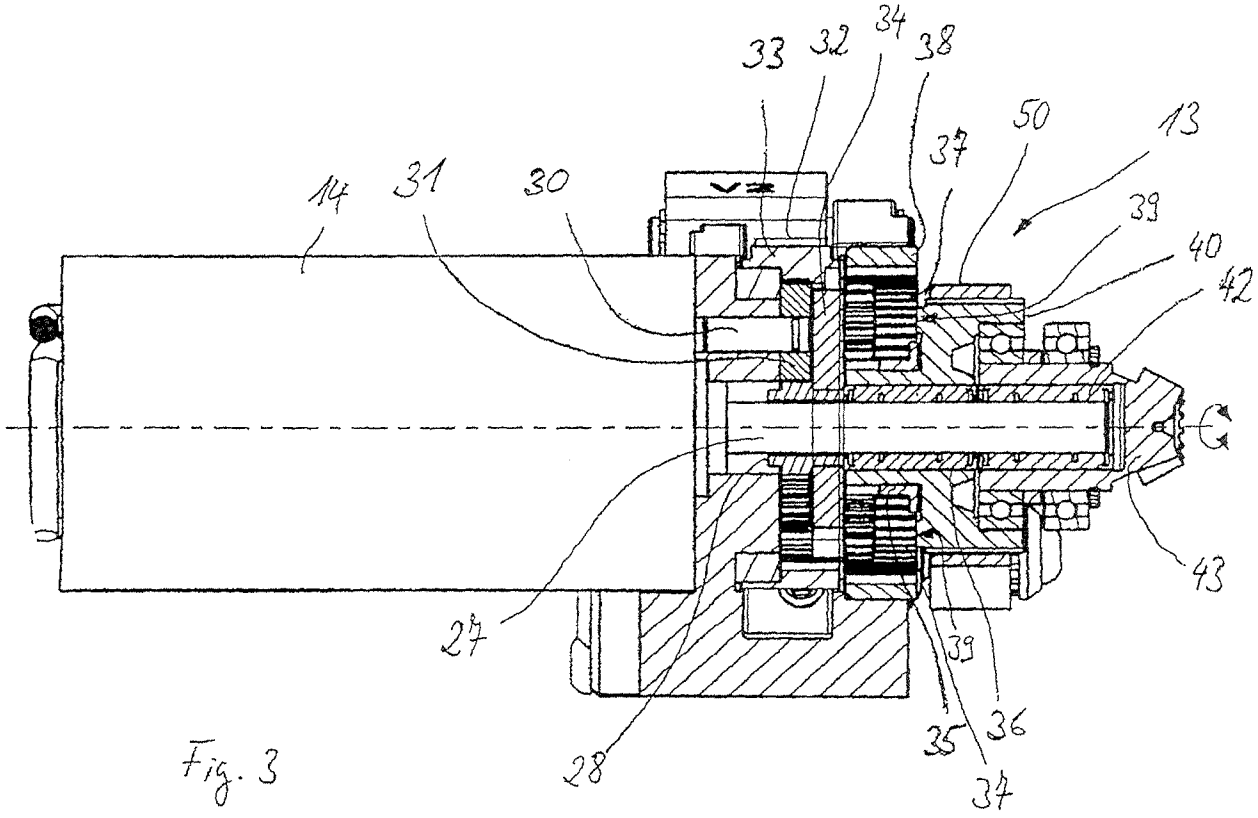
FIG. 3 shows a partial section view of the motor of the strapping device in FIG. 1, together with components arranged on the motor shaft.

On a motor shaft 27, shown in FIG. 3, of the brushless, grooved rotor direct current motor 14 a gearing system device 13 is arranged. In the example of embodiment shown here a type EC140 motor manufactured by Maxon Motor AG, Brünigstrasse 20, 6072 Sachseln is used. The brushless direct current motor 14 can be operated in both rotational directions, whereby one direction is used as the drive movement of the tensioner 6 and the other direction as the drive movement of the welding device 10.

Figure 4:
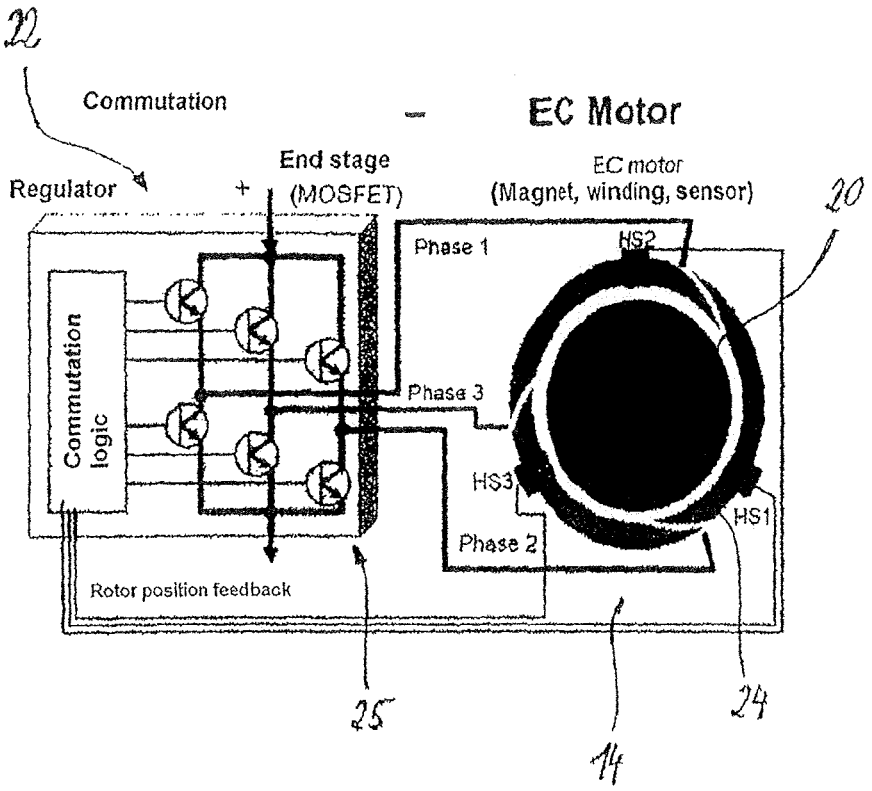
FIG. 4 shows a very schematic view of the motor along with its electronic commutation switch.

The brushless direct current motor 14, shown purely schematically in FIG. 4, is designed with a grooved rotor 20 with three Hall sensors HS1, HS2, HS3. In its rotor 20, this EC motor (electronically commutated motor) has a permanent magnet and is provided with an electronic control 22 intended for electronic commutation in the stator 24. Via the Hall sensors, HS1, HS2, HS3, which in the example of embodiment also assume the function of position sensors, the electronic control 22 determines the current position of the rotor 20 and controls the electrical magnetic field in the windings of the stator 24. The phases (phase 1, phase 2, phase 3) can thus be controlled depending in the position of the rotor 20, in order to bring about a rotational movement of the rotor in a particular rotational direction with a predeterminable variable rotational speed and torque. In this present case a "1$^{st}$ quadrant motor drive intensifier" is used, which provides the motor with the voltage as well as peak and continuous current and regulates these. The current flow for coil windings of the stator 24, which are not shown in more detail, is controlled via a bridge circuit 25 (MOSFET transistors), i.e. commutated. A temperature sensor, which is not shown in more detail, is also provided on the motor. In this way the rotational direction, rotational speed, current limitation and temperature can be monitored and controlled. The commutator is designed as a separate print component and is accommodated in the strapping device separately from the motor.

The power supply is provided by the lithium-ion storage battery 15. Such storage batteries are based on several independent lithium ion cells in each of which essentially separate chemical processes take place to generate a potential difference between the two poles of each cell. In the example of embodiment the lithium ion storage battery is manufactured by Robert Bosch GmbH, D-70745 Leinfelden-Echterdingen. The battery in the example of embodiment has eight cells and has a capacity of 2.6 ampere-hours. Graphite is used as the active material/negative electrode of the lithium ion storage battery. The positive electrode often has lithium metal oxides, more particularly in the form of layered structures. Anhydrous salts, such as lithium hexafluorophosphate or polymers are usually used as the electrolyte. The voltage emitted by a conventional lithium ion storage battery is usually 3.6 volts. The energy density of such storage batteries is around 100 Wh/kh-120 Wh/kg.

On the motor side drive shaft, the gearing system device 13 has a free wheel 36, on which a sun gear 35 of a first planetary gear stage is arranged. The free wheel 36 only transfers the rotational movement to the sun gear 35 in one of the two possible rotational directions of the drive. The sun gear 35 meshes with three planetary gears 37 which in a known manner engage with a fixed gear 38. Each of the planetary gears 37 is arranged on a shaft 39 assigned to it, each of which is connected in one piece with an output gear 40. The rotation of the planetary gears 37 around the motor shaft 27 produces a rotational movement of the output gear 40 around the motor shaft 27 and determines a rotational speed of this rotational movement of the output gear 40. In addition to the sun gear 35 the output gear 40 is also on the free wheel 36 and is therefore also arranged on the motor shaft. This free wheel 36 ensures that both the sun gear 35 and the output gear 40 only also rotate in one rotational direction of the rotational movement of the motor shaft 27. The free wheel 29 can for example be of type INA HFL0615 as supplied by the company Schaeffler KG, D-91074 Herzogenaurach, On the motor-side output shaft 27 the gear system device 13 also has a toothed sun gear 28 belonging to a second planetary gear stage, through the recess of which the shaft 27 passes, though the shaft 27 is not connected to the sun gear 28. The sun gear is attached to a disk 34, which in turn is connected to the planetary gears. The rotational movement of the planetary gears 37 about the motor-side output shaft 27 is thus transferred to the disk 34, which in turn transfers its rotational movement at the same speed to the sun gear 28. With several planetary gears, namely three, the sun gear 28 meshes with cog gears 31 arranged on a shaft 30 running parallel to the motor shaft 27. The shafts 30 of the three cog gears 31 are fixed, i.e. they do not rotate about the motor shaft 27. In turn the cog gears 21 engage with an internal-tooth sprocket, which on its outer side has a cam 32 and is hereinafter referred to as the cam wheel 33. The sun gear 28, the three cog gears 31 as well as the cam wheel 33 are components of the second planetary gear stage. In the planetary gear system the input-side rotational movement of the shaft 27 and the rotational movement of the cam wheel are at a ratio of 60:1, i.e. a 60-fold reduction takes place through the second-stage planetary gear system.

At the end of the motor shaft 27, on a second free wheel 42 a bevel gear 43 is arranged, which engages in a second bevel gear, which is not shown in more detail. This free wheel 42 also only transmits the rotational movement in one rotational direction of the motor shaft 27. The rotational direction in which the free wheel 36 of the sun gear 35 and the free wheel 42 transmit the rotational movement of the motor shaft 27 is opposite. This means that in one rotational direction only free wheel 36 turns, and in the other rotational direction only free wheel 42.

The second bevel gear is arranged on one of a, not shown, tensioning shaft, which at its other end carries a further planetary gear system 46 (FIG. 2). The drive movement of the electric motor in a particular rotational direction is thus transmitted by the two bevel gears to the tensioning shaft. Via a sun gear 47 as well as three planetary gears 48 the tensioning wheel 49, in the form of an internally toothed sprocket, of the tensioner 6 is rotated. During rotation the tensioning wheel 7, provided with a surface structure on its outer surface, moves the wrapping strap through friction, as a result of which the strap loop is provided with the envisaged tension.

Figure 5:
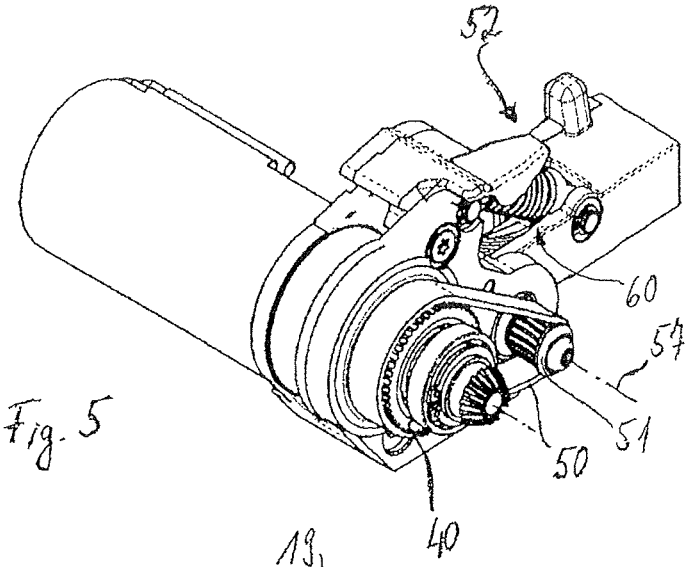
FIG. 5 shows a perspective partial view of the drive train of the strapping device in FIG. 1.
Figure 6:
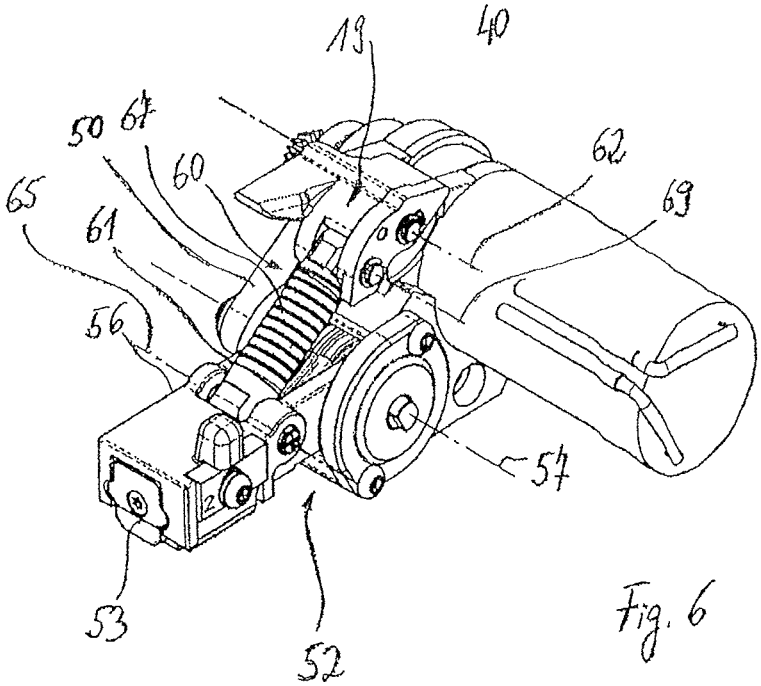
FIG. 6 shows the drive train in FIG. 5 from another direction of view.

In the area of its outer circumference the output gear 40 is designed as a cog gear on which is a toothed belt 50 of an envelope drive (FIGS. 5 and 6). The toothed belt 50 also goes round pinion 51, smaller in diameter than the output gear 40, the shaft of which drive an eccentric drive 52 for producing an oscillating to and fro movement of the welding shoe 53.

Instead of toothed belt drive any other form of envelope drive could be provided, such as a V-belt or chain drive. The eccentric drive 52 has an eccentric shaft 54 on which an eccentric tappet 55 is arranged on which in turn a welding shoe arm 56 with a circular recess is mounted. The eccentric rotational movement of the eccentric tappet 55 about the rotational axis 57 of the eccentric shaft 54 results in a translator oscillating to and fro movement of the welding shoe 53. Both the eccentric drive 52 as well as the welding shoe 53 it can be designed in any other previously known manner.

Figure 9:
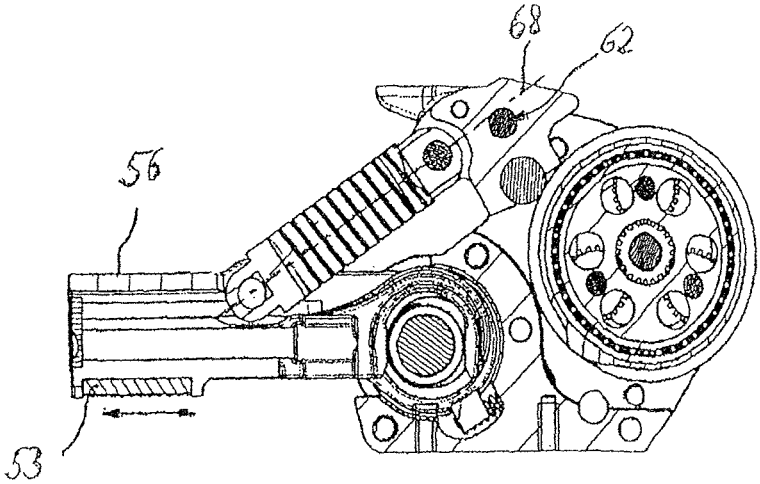
FIG. 9 shows a side view of the drive train in FIG. 5 with the welding device in a welding position.

The welding device is also provided with a toggle lever device 60, by means of which the welding device can be moved from a rest position (FIG. 7) into a welding position (FIG. 9). The toggle lever device 60 is attached to the welding shoe arm 56 and provided with a longer toggle lever 61 pivotably articulated on the welding shoe arm 56. The toggle lever device 60 is also provided with a pivoting element 63, pivotably articulated about a pivoting axis 62, which in the toggle level device 60 acts as the shorter toggle lever. The pivoting axis 62 of the pivoting element 63 runs parallel to the axes of the motor shaft 27 and the eccentric shaft 57.

Figure 7:
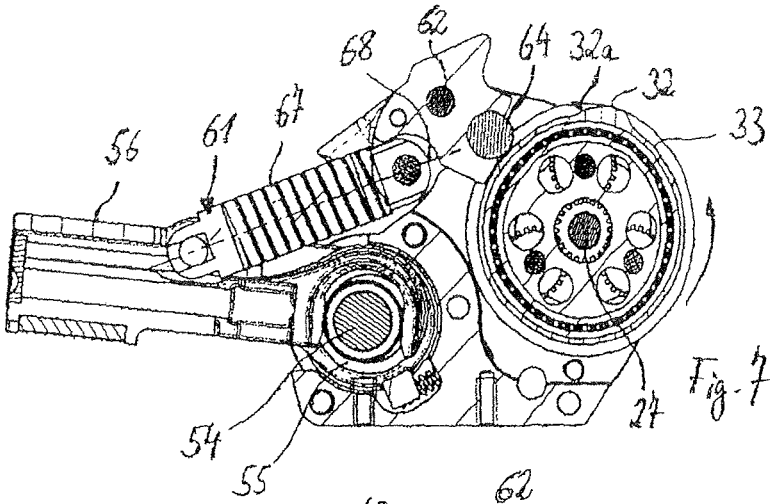
FIG. 7 shows a side view of the drive train in FIG. 5 with the welding device in the rest position.
Figure 8:
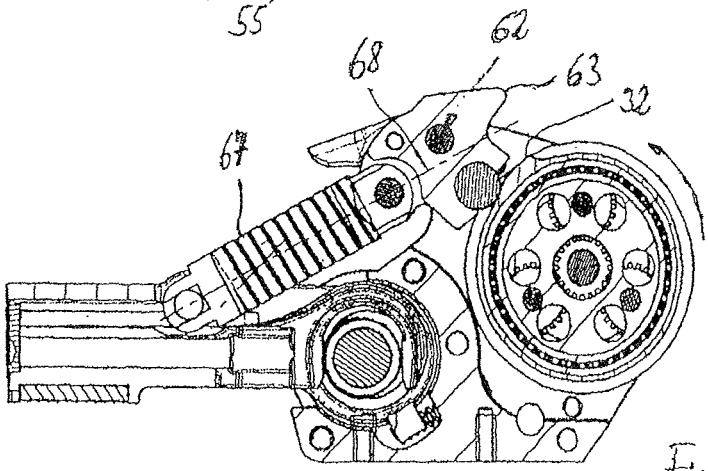
FIG. 8 shows a side view of the drive train in FIG. 6 with the welding device in a position between two end positions.

The pivoting movement is initiated by the cam 32 on the cam wheel 33 which during rotational movement in the anticlockwise direction—in relation to the depictions in FIGS. 7 to 9—of the cam wheel 33 ends up under the pivoting element 63 (FIG. 8). A ramp-like ascending surface 32*a* of the cam 32 comes into contact with a contact element 64 set into the pivoting element 63. The pivoting element 63 is thus rotated clockwise about its pivoting axis 62. In the area of a concave recess of the pivoting element 63 a two-part longitudinally-adjustable toggle lever rod of the toggle lever 61 is pivotably arranged about a pivoting axis 69 in accordance with the 'piston cylinder' principle. The latter is also rotatably articulated on an articulation point 65, designed as a further pivoting axis 65, of the welding shoe arm 56 in the vicinity of the welding shoe 53 and at a distance from the pivoting axis 57 of the welding shoe arm 56. Between both ends of the longitudinally adjustable toggle lever rod a pressure spring 67 is arranged thereon, by means of which the toggle lever 61 is pressed against both the welding shoe arm 56 as well as against the pivoting element 63. In terms of its pivoting movements the pivoting element 63 is thus functionally connected to the toggle lever 61 and the welding shoe arm 56.

As can be seen in the depictions in FIG. 7, in the rest position there is an (imaginary) connecting line 68 for both articulation points of the toggle lever 61 running through the toggle lever 61 between the pivoting axis 62 of the pivoting element 63 and the cam wheel 33, i.e. on one side of the pivoting axis 62. By operating the cam wheel 33 the pivoting element 63 is rotated clockwise—in relation to the depictions in FIGS. 7 to 9. In this way the toggle lever 61 of the pivoting 63 is also operated. In FIG. 8 an intermediate position of the toggle lever 61 is shown in which the connecting line 68 of the articulation points 65, 69 intersects the pivoting axis 62 of the pivoting element 63. In the end position of the movement (welding position) shown in FIG. 9 the toggle lever 61 with its connecting line 68 is then on the other side of the pivoting axis 62 of the pivoting element 63 in relation to the cam wheel 33 and the rest position. During this movement the welding arm shoe 56 is transferred by the toggle lever 61 from its rest position into the welding position by rotation about the pivoting axis 57. In the latter position the pressure spring 67 presses the pivoting element 63 against a stop, not shown in further detail, and the welding shoe 53 onto the two strap layers to be welded together. The toggle lever 61, and therefore also the welding shoe arm 56, is thus in a stable welding position.

The anticlockwise drive movement of the electric motor shown in FIGS. 6 and 9 is transmitted by the toothed belt 50 to the welding shoe 53, brought into the welding position by the toggle lever device 60, which is pressed onto both strap layer and moved to and fro in an oscillating movement. The welding time for producing a friction weld connection is determined by way of the adjustable number of revolutions of the cam wheel 33 being counted as of the time at which the cam 32 operates the contact element 64. For this the number of revolutions of the shaft 27 of the brushless direct current motor 14 is counted in order to determine the position of the cam wheel 33 as of which the motor 14 should switch off and thereby end the welding procedure. It should be avoided that on switching off the motor 14 the cam 32 comes to a rest under the contact element 64. Therefore, for switching off the motor 14 only relative positions of the cam 32 with regard to the pivoting element 63 are envisaged, a which the cam 32 is not under the pivoting element. This ensures that the welding shoe arm 56 can pivot back from the welding position into the rest position (FIG. 7). More particularly, this avoids a position of the cam 32 at which the cam 32 would position the toggle lever 61 at a dead point, i.e. a position in which the connecting line 68 of the two articulation points intersects the pivoting axis 62 of the pivoting element 63—as shown in FIG. 8. As such a position is avoided, by means of operating the rocker lever the rocker (FIG. 2) can be released from the tensioning wheel 7 and the toggle lever 61 pivoted in the direction of the cam wheel 33 into the position shown in FIG. 7. After the strap loop has been taken out of the strapping device, the latter is ready for a further strapping procedure.

The described consecutive procedures "tensioning" and "welding" can be jointly initiated in one switching status of the operating element 15. For this the operating element 16 is operated once, whereby the electric motor 14 first turns on the first rotational direction and thereby (only) the tensioner 6 is driven. The strap tension to be applied to the strap can be set on the strapping device, preferably be means of a push button in nine stages, which correspond to nine different strap tensions. Alternatively continuous adjustment of the strap tension can be envisaged. As the motor current is dependent on the torque of the tensioning wheel 7, and this in turn on the current strap tension, the strap tension to be applied can be set via push buttons in nine stages in the form of a motor current limit value on the control electronics of the strapping device.

After reaching a settable and thus predeterminable limit value for the motor current/strap tension, the motor 14 is switched off by its control device 22. Immediately afterwards the control device 22 operates the motor in the opposite rotational direction. As a result, in the manner described above, the welding shoe is lowered onto the two layers of strap displaced one on top of the other and the oscillating movement of the welding shoe is carried out to produce the friction weld connection.

By operating switch 17 the operating element 16 can only activate the tensioner. If this is set, by operating the operating element only the tensioner is brought into operation and on reaching the preset strap tension is switched off again. To start the friction welding procedure the second operating element 18 must be operated. However, apart from separate activation, the function of the friction welding device is identical the other mode of the first operating element.

Figure 11:
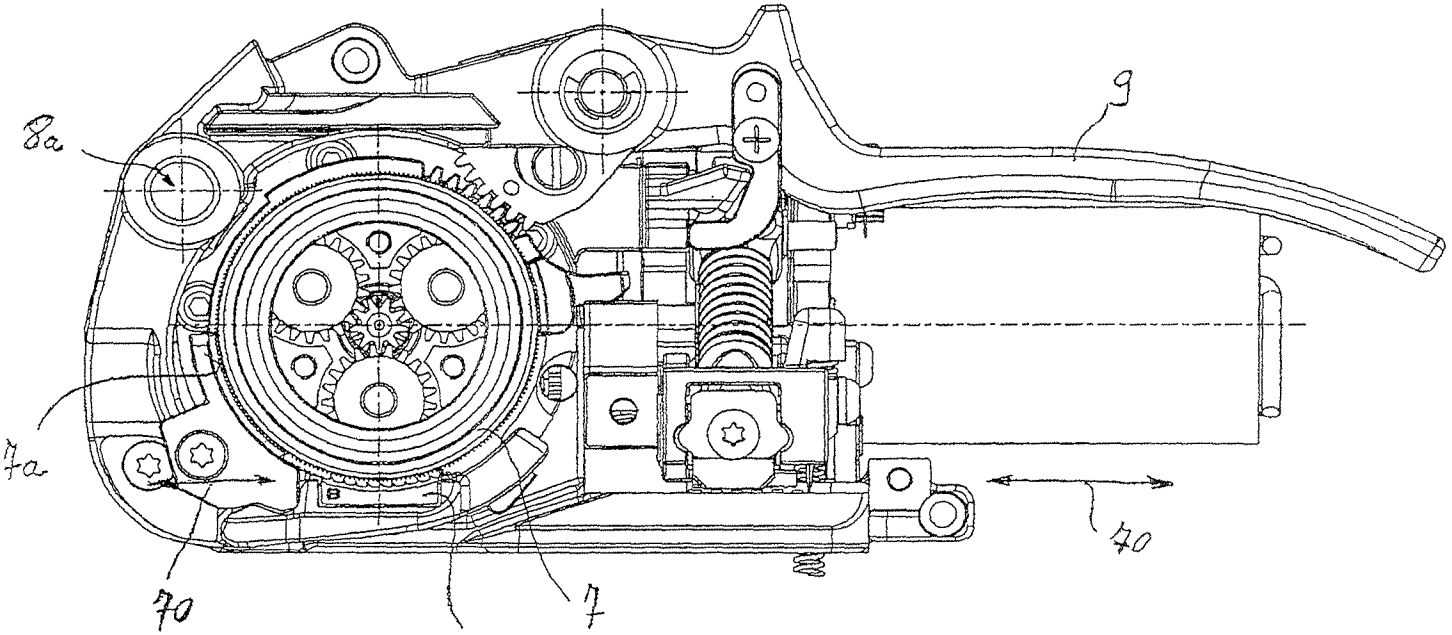
FIG. 11 shows a side view of the tensioner of the strapping device without the casing in which a tensioning rocker is in a tensioning position.

As has already been explained, the rocker 8 can through operating the rocker lever 9 shown in FIGS. 2, 10, 11 carry out pivoting movements about the rocker axis 8*a*. For this, the rocker is moved by a rotating cam disc which is behind the tensioning wheel 7 and cannot therefore be seen in FIG. 2. Via the rocker lever 9 the cam disc can carry out a rotational movement of approx. 30° and move the rocker 8 and/or the tensioning plate 12 relative to the tensioning wheel 7 which allow the strap to be inserted into the strapping device/between the tensioning wheel 7 and tensioning plate 12.

In this way, the toothed tensioning plate arranged on the free end of the rocker can be pivoted from a rest position shown in FIG. 10 into a tensioning position shown in FIG. 11 and back again. In the rest position the tensioning plate 12 is at sufficiently great distance from the tensioning wheel 7 that a wrapping strap can be placed in two layers between the tensioning wheel and the tensioning plate as required for producing connection on a strap loop. In the tensioning position the tensioning plate 12 is pressed in a known way, for example by means of a spring force acting on the rocker, against the tensioning wheel 7, whereby, contrary to what is shown in FIG. 11, in a strapping procedure the two-layer strap is located between the tensioning plate and the tensioning wheel and thus there should be no contact between the two latter elements: The toothed surface 12*a* (tensioning surface) facing the tensioning wheel 7 is concavely curved whereby the curvature radius corresponds with the radius of the tensioning wheel 7 or is slightly larger.

As can be seen in particular in FIGS. 10 and 11 as well as the detailed drawings of FIGS. 12-14, the toothed tensioning plate 12 is arranged in a grooved recess 71 of the rocker. The length—in relation to the direction of the strap—of the recess 71 is greater than the length of the tensioning plate 12. In addition, the tensioning plate 12 is provide with a convex contact surface 12*b* with which it is arranged on a flat contact surface 71 in the recess 71 of the rocker 8. As shown in particular in FIGS. 11 and 12 the convex curvature runs in a direction parallel to the strap direction 70, while the contact surface 12*b* is designed flat and perpendicular to this direction (FIG. 13). As a result of this design the tensioning plate 12 is able to carry out pivoting movements in the strap direction 70 relative to the rocker 8 and to the tensioning wheel 7. The tensioning plate 12 is also attached to the rocker 8 by means of a screw 72 passing through the rocker from below. This screw is in an elongated hole 74 of the rocker, the longitudinal extent of which runs parallel to the course of the strap 70 in the strapping device. As a result in addition to be pivotable, the tensioning plate 12 is also arranged on the rocker 8 in a longitudinally adjustable manner.

In a tensioner the tensioning rocker 8 is initially moved from the rest position (FIG. 10) into the tensioning position (FIG. 11). In the tensioning position the sprung rocker 8 presses the tensioning plate in the direction of the tensioning wheel and thereby clamps the two strap layers between the tensioning wheel 7 and the tensioning plate 12. Due to different strap thicknesses this can result in differing spacings between the tensioning plate 12 and circumferential surface 7*a* of the tensioning wheel 7. This not only results in different pivoting positions of the rocker 8, but also different positions of the tensioning plate 12 in relation to the circumferential direction of the tensioning wheel 7. In order to still achieve uniform pressing conditions, during the pressing procedure the tensioning plate 12 adjusts itself to the strap through a longitudinal movement in the recess 71 as well as a pivoting movement via the contact surface 12*b* on contact surface 72 so that the tensioning plate 12 exerts as even a pressures as possible over its entire length on the wrapping strap. If the tensioning wheel 7 is then switched on the toothing of tensioning plate 12 holds the lower strap layer fast, while the tensioning wheel 7 grasps the upper strap layer with its toothed circumferential surface 7*a*. The rotational movement of the tensioning wheel 7 as well the lower coefficient of friction between the two strap layers then results in the tensioning wheel pulling back the upper band layer, thereby increasing the tension in the strap loop up to the required tensile force value.

List of references

| | | | |
|---|---|---|---|
| 1. | Strapping device 1 | 30. | Shaft |
| 2. | Casing | 31. | Cog wheel |
| 3. | Grip | 32. | Cam |
| 4. | Base plate | 32a. | Surface |
| 6. | Tensioner | 33. | Cam wheel |
| 7. | Tensioning wheel | 35. | Sun gear |
| 7a. | Circumferential surface | 36. | Free wheel |
| 8. | Rocker | 37. | Planetary gear |
| 8. | Rocker pivoting axis | 38. | Socket |
| 9. | Rocker lever | 39. | Shaft |
| 10. | Friction welder | 40. | Output gear |
| 11. | Welding shoe | 42. | Free wheel |
| 12. | Tensioning plate | 43. | Bevel gear |
| 12a. | Tensioning surface | 46. | Planetary gear system |
| 12b. | Contact surface | 47. | Sun gear |
| 13. | Gear system device | 48. | Planetary gear |
| 14. | Electric direct current motor | 49. | Tensioning wheel |
| 15. | Storage battery | 50. | Toothed belt |
| 16. | Operating element | 51. | Pinion |
| 17. | Switch | 52. | Eccentric drive |
| 18. | Operating element | 53. | Welding shoe |
| 19. | Transmission device | 54. | Eccentric shaft |
| 20. | Rotor | 55. | Eccentric tappet |
| HS1 | Hall sensor | 56. | Welding shoe arm |
| HS2 | Hall sensor | 57. | Rotational axis eccentric shaft |
| HS3 | Hall sensor | 60. | Toggle lever device |
| 22. | Electronic control | 61. | Longer toggle lever |
| 24. | Stator | 62. | Pivoting axis |
| 25. | Bridging cicuit | 63. | Pivoting element |
| 27. | Motor side output shaft | 64. | Contact element |
| 28. | Sun gear | 65. | Pivoting axis |
| 66. | Pivoting axis | 72. | Contact surface |
| 67. | Pressure spring | 73. | Screw |
| 68. | Connecting line | 74. | Elongated hole |
| 69. | Pivoting axis | | |
| 70. | Strap direction | | |
| 71. | Recess | | |

The invention claimed is:

1. A strapping device for strapping packaged goods with a wrapping strap, comprising:

a tensioner for applying a strap tension to a loop of wrapping strap, the tensioner having a rotationally drivable tensioning wheel and a tensioning rocker that pivots relative to the tensioning wheel and engages with the tensioning wheel, wherein said tensioning rocker includes a grooved recess having a lower flat surface, wherein a tensioning plate having a lower convex curvature contact surface is attached to the tensioning rocker by a fastener passing through a bottom of the tensioning rocker such that the tensioning plate is pivotably disposed in said grooved recess of the tensioning rocker, such that at least part of the lower convex curvature contact surface of the tensioning plate abuts the lower flat surface of the grooved recess, such that a variation in the relative position of the tensioning plate longitudinally in relation to the tensioning wheel can be produced, and such that the tensioning plate is longitudinally movable in at least one direction relative to the tensioning rocker, and wherein a distance between the tensioning plate and the tensioning wheel can be varied to apply a tensile force on the wrapping strap; and a connector including a friction welding element for producing a friction weld connection at two areas of the wrapping strap disposed one on top of the other.

2. The mobile strapping device in accordance with claim 1, characterized by floating mounting of the tensioning plate on the tensioning rocker.

3. The mobile strapping device in accordance with claim 1, characterized by swaying bearing of the tensioning plate on the tensioning rocker.

4. The mobile strapping device in accordance with claim 1, characterized by means with which the tensioning rocker can be force-stressed in the direction of the tensioning wheel during a tensioning procedure.

5. The mobile strapping device in accordance with claim 1, wherein a tensioning surface of the tensioning plate which is envisage for coming into contact with the wrapping strap, has a concave curvature.

6. The mobile strapping device in accordance with claim 5, characterized in that a curvature radius of the tensioning surface is equal to or larger than a radius of a circumferential surface of the tensioning wheel.

7. The mobile strapping device in accordance with claim 1, characterized by chargeable energy storage means for storing energy in the form of electrical, mechanical, elastic or potential energy, which can be released as drive energy at least for the connector for producing the friction weld connection.

8. The mobile strapping device in accordance with claim 1, wherein the tensioning plate includes an upper toothed surface.

9. The mobile strapping device in accordance with claim 1, wherein a length of the grooved recess is greater than a length of the tensioning plate, the length of the tensioning plate being parallel to the length of the grooved recess.

10. The mobile strapping device in accordance with claim 1, wherein the fastener includes a screw.

11. The mobile strapping device in accordance with claim 10, wherein the screw is located in an elongated hole of the tensioning plate, a longitudinal extent of which runs perpendicularly to the strap direction.

12. The mobile strapping device in accordance with claim 1, wherein the grooved recess runs in a direction parallel to an axial direction of the tensioning wheel.

13. The mobile strapping device in accordance with claim 1, wherein the grooved recess includes sidewalls that face one another that run in a direction parallel to an axial direction of the tensioning wheel.

14. The mobile strapping device in accordance with claim 13, wherein the tensioning plate is located in between the sidewalls.

15. A strapping device for strapping packaged goods with a wrapping strap, comprising:

a tensioner configured to apply a strap tension to a loop of wrapping strap, the tensioner having a rotationally drivable tensioning wheel and a tensioning rocker that pivots relative to the tensioning wheel and engages with the tensioning wheel, wherein said tensioning rocker includes a grooved recess having a lower flat surface, wherein a tensioning plate having a lower convex curvature contact surface is attached to the tensioning rocker by a fastener passing through a bottom of the tensioning rocker such that the tensioning plate is pivotably disposed in said grooved recess of the tensioning rocker, such that at least part of the lower convex curvature contact surface of the tensioning plate abuts the lower flat surface of the grooved recess, such that a variation in the relative position of the tensioning plate longitudinally in relation to the tensioning wheel can be produced, and such that the tensioning plate is longitudinally movable in at least one direction relative to the tensioning rocker, and wherein a distance between the tensioning plate and the tensioning wheel can be varied to apply a tensile force on the wrapping strap; and a friction welder for producing a friction weld connection by way of a friction welding element at two areas of the loop of wrapping strap disposed one on top of the other.

16. The mobile strapping device in accordance with claim 15 configured with floating mounting of the tensioning plate on the tensioning rocker.

17. The mobile strapping device in accordance with claim 15 configured with swaying bearing of the tensioning plate on the tensioning rocker.

18. The mobile strapping device in accordance with claim 15, wherein the device is configured such that the tensioning rocker can be force-stressed in the direction of the tensioning wheel during a tensioning procedure.

19. The mobile strapping device in accordance with claim 15, wherein a tensioning surface of the tensioning plate which is envisage for coming into contact with the wrapping strap, has a concave curvature.

20. The mobile strapping device in accordance with claim 19, wherein a curvature radius of the tensioning surface is equal to or larger than a radius of a circumferential surface of the tensioning wheel.

21. The mobile strapping device in accordance with claim 15, further including a chargeable energy storage device configured to store energy which can be released as drive energy at least for the friction welder for producing the connection.

22. The mobile strapping device in accordance with claim 15, wherein the tensioning plate includes an upper toothed surface.

23. The mobile strapping device in accordance with claim 15, wherein a length of the grooved recess is greater than a length of the tensioning plate, the length of the tensioning plate being parallel to the length of the grooved recess.

24. The mobile strapping device in accordance with claim 15, wherein the fastener includes a screw.

25. The mobile strapping device in accordance with claim 24, wherein the screw is located in an elongated hole of the tensioning plate, a longitudinal extent of which runs perpendicularly to the strap direction.

26. The mobile strapping device in accordance with claim 15, wherein the grooved recess runs in a direction parallel to an axial direction of the tensioning wheel.

27. The mobile strapping device in accordance with claim 15, wherein the grooved recess includes sidewalls that face one another that run in a direction parallel to an axial direction of the tensioning wheel.

28. The mobile strapping device in accordance with claim 27, wherein the tensioning plate is located in between the sidewalls.

* * * * *